US006976425B2

(12) United States Patent
Morikawa et al.

(10) Patent No.: US 6,976,425 B2
(45) Date of Patent: Dec. 20, 2005

(54) INK FEEDING RATE CONTROL METHOD AND AN INK FEEDING RATE CONTROL APPARATUS

(75) Inventors: Hideki Morikawa, Kyoto (JP); Shigeo Murakami, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 191 days.

(21) Appl. No.: 10/698,370

(22) Filed: Nov. 3, 2003

(65) Prior Publication Data

US 2004/0123760 A1 Jul. 1, 2004

(30) Foreign Application Priority Data

Dec. 26, 2002 (JP) ..... 2002-377217

(51) Int. Cl.[7] ..... B41M 1/14
(52) U.S. Cl. ..... 101/364; 101/484; 101/211
(58) Field of Search ..... 101/365, 484, 101/483, DIG. 47

(56) References Cited

U.S. PATENT DOCUMENTS

| | | | | |
|---|---|---|---|---|
| 3,958,509 | A * | 5/1976 | Murray et al. | 101/350.1 |
| 4,656,941 | A * | 4/1987 | Brovman | 101/483 |
| 5,163,012 | A | 11/1992 | Wuhrl et al. | |
| 6,382,101 | B1 | 5/2002 | Richards | |
| 6,698,355 | B2 * | 3/2004 | Fukui | 101/485 |
| 6,715,945 | B2 * | 4/2004 | Yamamoto et al. | 400/120.09 |
| 2001/0020427 | A1 * | 9/2001 | Shiraishi | 101/365 |
| 2001/0038388 | A1 | 11/2001 | Shiraishi | |
| 2002/0043166 | A1 * | 4/2002 | Okuda | 101/181 |

FOREIGN PATENT DOCUMENTS

| | | | |
|---|---|---|---|
| DE | 3206812 | A1 | 10/1982 |
| EP | 1 080 892 | A2 | 3/2001 |
| EP | 1 136 266 | A1 | 9/2001 |
| EP | 1 149 703 | A2 | 10/2001 |
| EP | 1 197 331 | A1 | 4/2002 |
| JP | 57-142367 | | 9/1982 |
| JP | 04-303660 | | 10/1992 |
| JP | 08-261829 | | 10/1996 |
| JP | 10-305562 | | 11/1998 |
| JP | 11-296672 | | 10/1999 |
| JP | P2001-253054 | | 9/2001 |
| JP | P2001-293840 | | 10/2001 |
| JP | P2001-353852 | | 12/2001 |

* cited by examiner

*Primary Examiner*—Andrew H. Hirshfeld
*Assistant Examiner*—Leo T. Hinze
(74) *Attorney, Agent, or Firm*—McDermott Will & Emery

(57) ABSTRACT

An ink feeding rate control method includes a reference print preparing step for making a printing plate by recording an image thereon based on first image data for recording a reference chart, and obtaining a reference print, a reference print colorimetric step for obtaining color data by reading the reference print, a conversion table preparing step for preparing a conversion table from the first image data and the color data of the reference print, a reference color data converting step for converting second image data for recording an image into reference color data by using the conversion table, a print preparing step for making a printing plate by using the second image data, and printing a print, a print colorimetric step for obtaining print color data by reading the print, and an ink feeding rate adjusting step for comparing the reference color data and the print color data, and adjusting ink feeding rates.

15 Claims, 7 Drawing Sheets

(a)

(b)

(c)

(d)

INK FEEDING RATE CONTROL METHOD AND AN INK FEEDING RATE CONTROL APPARATUS

BACKGROUND OF THE INVENTION

1. Field of the Invention

This invention relates to an ink feeding rate control method and an ink feeding rate control apparatus for adjusting ink feeding rates of a printing machine when performing a printing operation by using printing plates with images printed thereon based on printing data.

2. Description of the Related Art

In order to perform proper printing with a printing machine, it is necessary to control ink feeding rates properly. For controlling the ink feeding rates, it has been conventional practice to measure densities of control strips with a densitometer and determine from density data whether the ink feeding rates are proper or not. However, the density data from the control strips alone is not necessarily sufficient for attaining a proper color tone and the like for a picture area.

For this reason, a print quality measuring apparatus is used which provides control data for controlling the ink feeding rates of a printing machine. The control data is produced by comparing an image on reference paper and an image on an actual print. The reference paper is also called proof paper, and serves as a reference indicating a color tone of finished prints to obtain proper prints. Printing paper actually printed is also called sampling paper which is extracted by the operator from a discharge station of a printing machine at certain intervals during a printing operation. The printing is considered proper when the color tone on the sampling paper substantially coincides with the color tone on the reference paper.

However, for controlling the ink feeding rates of the printing machine by using reference paper in this way, the reference paper must be made ready for use in advance. To avoid this inconvenience, a printing apparatus disclosed in Japanese Unexamined Patent Publication No. 2001-235054 uses, instead of reference paper, image data (digital data) used in making printing plates. That is, the printing apparatus disclosed in Publication No. 2001-235054 controls ink feeding rates of a printing machine by comparing image data used in recording an image on printing plates and data obtained by photographing an image actually printed on printing paper.

Where, as described in Publication No. 2001-235054, image data used in recording an image on printing plates is used in place of reference paper, a problem arises that the image is not printed with a desired color tone because of printing characteristics variable from one printing machine to another. That is, image data may be created by taking color characteristics of a particular printing machine into account. When ink feeding rates are controlled by comparing this image data and data obtained by photographing printing paper printed by a different printing machine, the result is a problem that the ink feeding rates are controlled to target colors different from what is originally intended.

SUMMARY OF THE INVENTION

The object of this invention, therefore, is to provide an ink feeding rate control method for controlling ink feeding rates accurately regardless of printing characteristics of a printing machine, even without using reference paper.

The above object is fulfilled, according to this invention, by an ink feeding rate control method for adjusting ink feeding rates of a printing machine when performing a printing operation using printing plates with an image recorded thereon based on printing data, the method comprising a reference print preparing step for making a first printing plate by recording an image thereon based on first image data for recording a reference chart including a plurality of color patches set beforehand, and printing a reference print with the first printing plate; a reference print colorimetric step for obtaining color data of the reference print by reading the reference print prepared in the reference print preparing step; a conversion table creating step for creating a conversion table based on the first image data and the color data of the reference print and showing a relationship between the first image data and the color data; a reference color data converting step for converting data of predetermined measurement positions of second image data for recording a desired image on the printing plates for use in printing, into reference color data by using the conversion table; a print preparing step for making a second printing plate by recording an image thereon based on the second image data, and printing a print with the second printing plate; a print colorimetric step for obtaining print color data of positions corresponding to the measurement positions by reading the print prepared in the print preparing step; and an ink feeding rate adjusting step for adjusting the ink feeding rates of the printing machine based on a result of comparison between the reference color data obtained in the reference color data converting step and the print color data.

With this ink feeding rate control method, the first image data is converted into reference color data by using the conversion table, and the ink feeding rates are adjusted by comparing the reference color data with the print color data. Thus, the ink feeding rates may be controlled accurately without using reference paper and regardless of the printing characteristics of the printing machine.

In one preferred embodiment, the reference chart includes a plurality of color patches with successively varying dot percentages for each of YMCK colors.

Preferably, the measurement positions are positions having a representative color characterizing the image of the print.

The representative color and the positions thereof may be determined for respective sections corresponding to ink keys in each ink well of the printing machine.

In another preferred embodiment, the reference chart includes color patches having dot percentages for printing a color corresponding to a particular color to be reproduced faithfully.

Preferably, the measurement positions are positions having a representative color characterizing the image of the print.

In a different aspect of the invention, an ink feeding rate control apparatus is provided for adjusting ink feeding rates of a printing machine when performing a printing operation using printing plates with an image recorded thereon based on printing data. The apparatus comprises an image pickup unit for reading a reference print printed with a first printing plate made by recording an image thereon based on first image data for recording a reference chart including a plurality of color patches set beforehand, and a print with a second printing plate made by recording an image thereon based on second image data for recording a desired image on the printing plates for use in printing; an image memory for storing color data of the reference print obtained by reading the reference print with the image pickup unit, and print color data of positions corresponding to predetermined measurement positions by reading, with the image pickup unit, the print printed with second printing plate; a conversion table creating device for creating a conversion table based on the first image data and the color data of the reference print stored in the image memory and showing a relationship between the first image data and the color data; a reference color data converting device for converting data of the measurement positions of the second image data into reference color data by using the conversion table; and a comparing device for comparing the reference color data provided by the reference color data converting device and the print color data stored in the image memory, to determine whether the print has a proper color tone.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
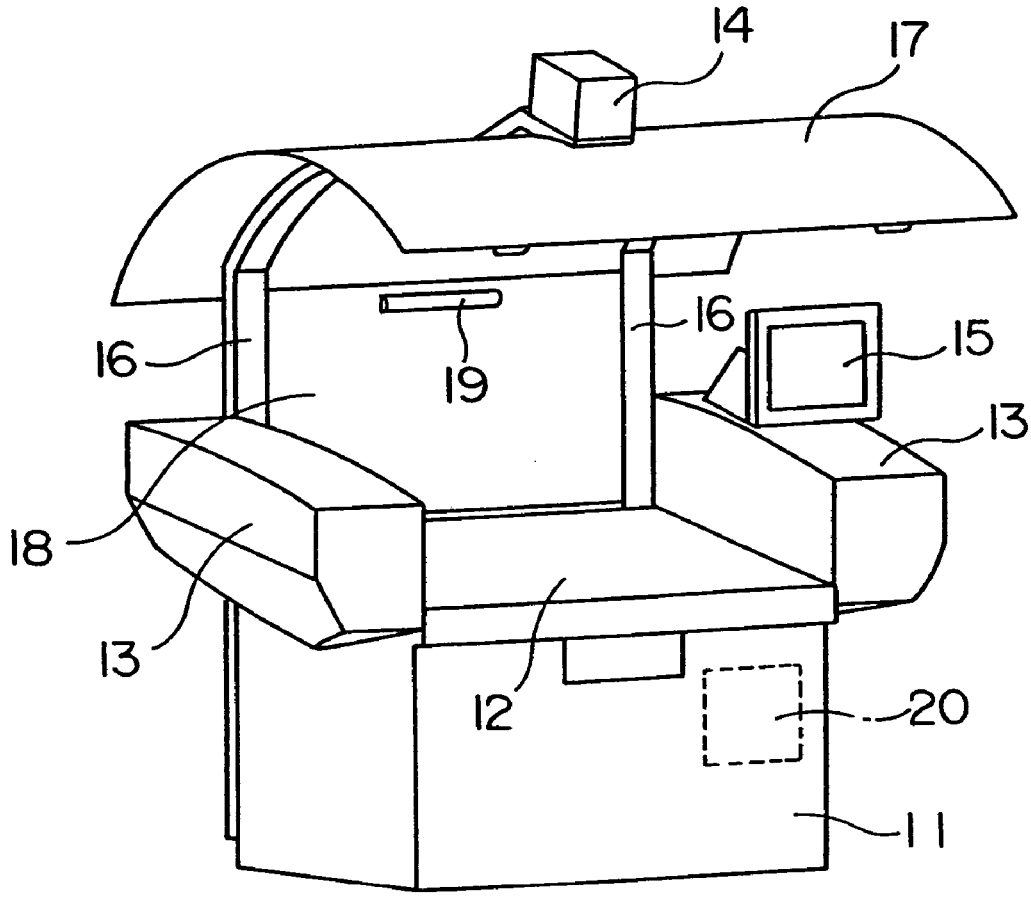
FIG. 1 is a perspective view of a print quality measuring apparatus for use in implementing this invention.
Figure 2:
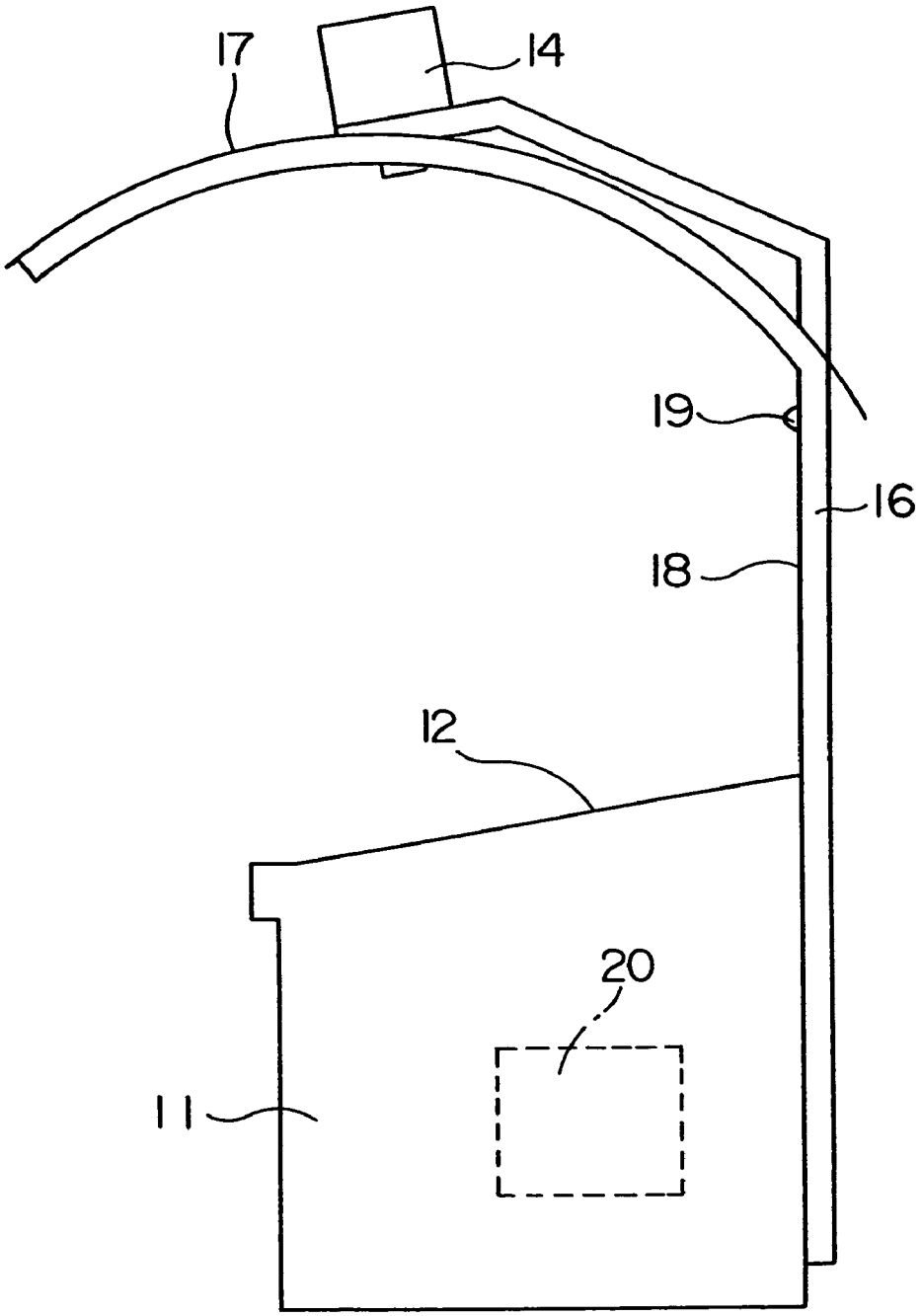
FIG. 2 is a side view of the print quality measuring apparatus.

An embodiment of this invention will be described hereinafter with reference to the drawings. A construction of a print quality measuring apparatus for use in implementing this invention will be described first. FIG. 1 is a perspective view of the print quality measuring apparatus. FIG. 2 is a side view of the apparatus. It is to be noted that light sources 13 and a control panel 15 are omitted from FIG. 2.

This print quality measuring apparatus includes a table 12 disposed above a frame 11, a pair of light sources 13 arranged at right and left sides of the table 12, an image pickup unit 14 disposed above the table 12, a control panel 15 disposed above one of the light sources 13, an upper light-shielding plate 17 and a rear light-shielding plate 18 supported by a pair of posts 16, an auxiliary light source 19 attached to the rear light-shielding plate 18, and a control unit 20 mounted inside the frame 11 for controlling the entire apparatus.

The table 12 is shaped planar for receiving a print thereon. The table 12 has a surface in the form of a suction plate for holding the print by static electricity or vacuum suction. The surface of the table 12 is inclined about 10 degrees for facility of operation by the operator. The print held by suction on the inclined surface of the table 12 is illuminated by the pair of light sources 13 arranged at the opposite sides.

The image pickup unit 14 disposed above the table 12 has a digital camera for separating, with a dichroic mirror, light emitted from the light sources 13 and reflected from the surface of the print into the three primary color components of RGB, and receiving the individual components with separate CCD arrays. With this image pickup unit 14, RGB data (individual density data in each RGB) can be obtained from the print.

The control panel 15 is the touch panel type in the form of an LCD monitor having a pressure sensitive input function (also called a touch sensitive screen). This control panel 15 acts as both a display device and an input device, and is connected to the control unit 20 described hereinafter.

Figure 3:
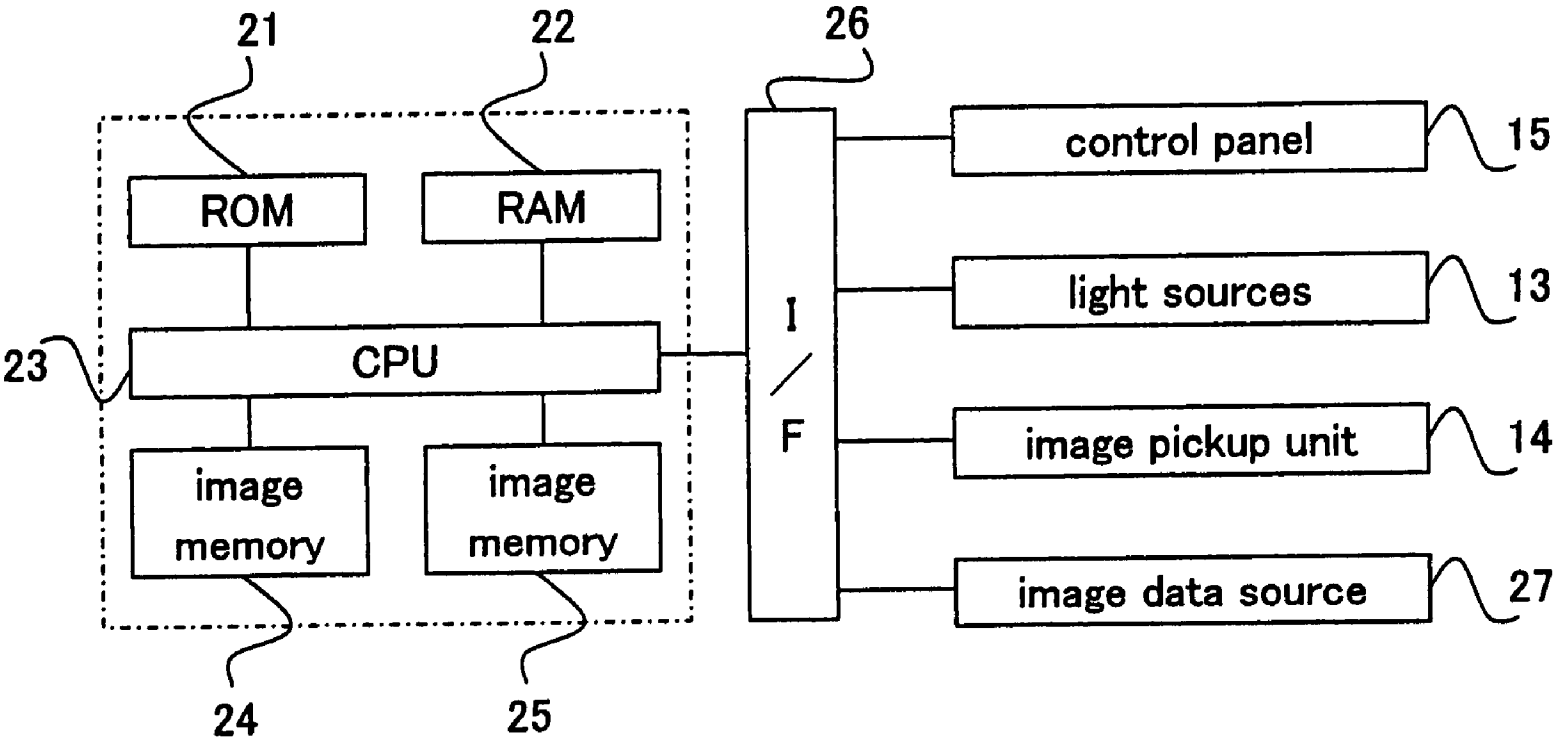
FIG. 3 is a block diagram showing a principal structure of a control unit.

FIG. 3 is a block diagram showing a principal structure of the control unit 20.

This control unit 20 includes a ROM 21 for storing operating programs necessary for controlling the apparatus, a RAM 22 for temporarily storing data and the like during a control operation, a CPU 23 for performing logic operations, an image memory 24 and a memory 25. The control unit 20 is connected through an interface 26 to the control panel 15, light sources 13 and image pickup unit 14 noted above. The control unit 20 is connected also to an image data source 27 storing image data to be printed, such as a hard disk or an image processing device.

Referring again to FIGS. 1 and 2, the upper light-shielding plate 17 supported by the pair of posts 16 has a curved configuration extending in the fore and aft direction of the print quality measuring apparatus. The light-shielding plate 17 is installed in order to intercept light, such as light from indoor light sources, that would constitute a regular reflection from the table 12. On the other hand, the rear light-shielding plate 18 supported between the pair of posts 16 serves to intercept light coming from behind the print quality measuring apparatus.

The auxiliary light source 19 attached to the rear light-shielding plate 18 serves to compensate for a lack of light on the table 12 caused by the upper light-shielding plate 17 and rear light-shielding plate 18. The auxiliary light source 19 is in the form of a fluorescent light or the like, which is turned off when reading a print with the image pickup unit 14.

In the print quality measuring apparatus having the above construction, a reference print or a print extracted by the operator from a discharge station of a printing machine during a printing operation is placed on the table 12, and held thereon by suction. The print is illuminated by the light sources 13, and the image of the print is read by the image pickup unit 14. Data of the image of the print is stored in the image memory 24 of the control unit 20. Conversion tables created in a conversion table creating step described hereinafter are stored in the memory 25. Then, a comparative calculation step described in detail hereinafter is executed to create control data for controlling ink feeding rates of the printing machine. This control data is transmitted on-line or off-line through the interface 26 to the printing machine not shown.

Figure 4:
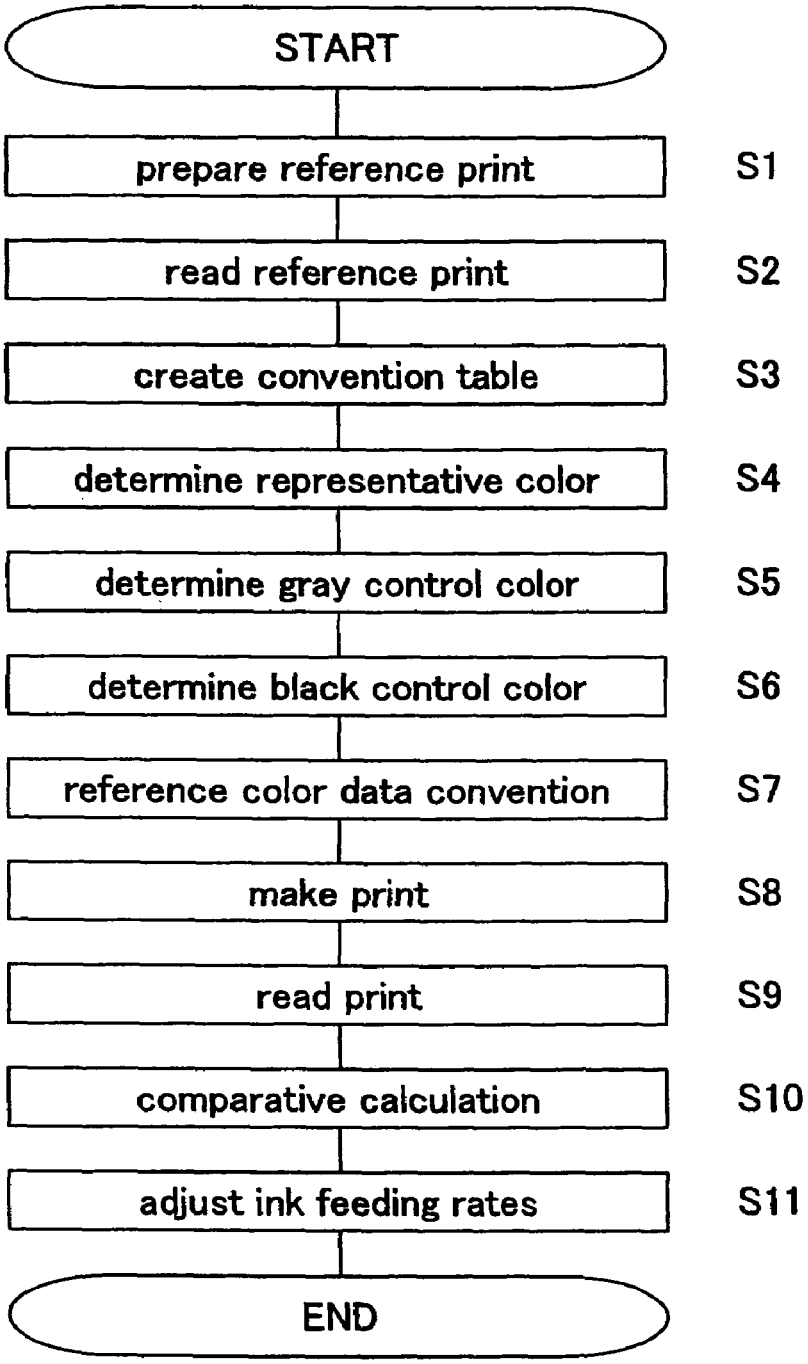
FIG. 4 is a flow chart of an ink feeding rate control operation according to this invention.

Each step of an ink feeding rate control operation according to this invention will be described hereinafter. FIG. 4 is a flow chart of the ink feeding rate control operation.

In the ink feeding rate control method according to this invention, a reference print is prepared first (step S1). The reference print includes a reference chart having a plurality of color patches printed thereon, and is used to obtain conversion tables described hereinafter. Printing plates for printing this reference print are made based on first image data for recording the reference chart. The first image data is supplied from the image data source 27 shown in FIG. 3.

Figure 5:
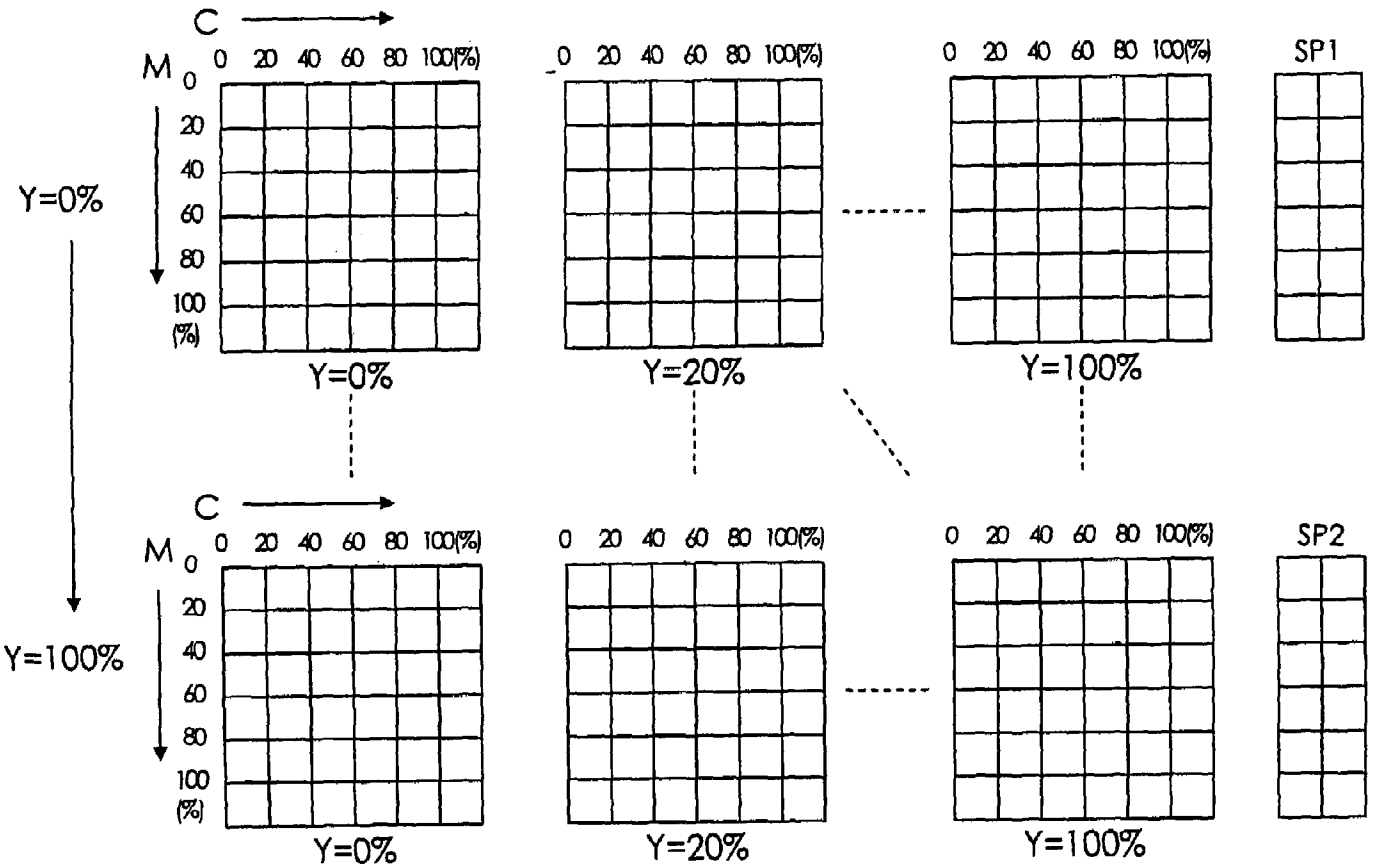
FIG. 5 is an explanatory view showing a reference chart printed on a reference print.

FIG. 5 is an explanatory view showing the reference chart printed on the reference print.

The reference chart includes a plurality of color patches with successively varying dot percentages for the CMYK colors (cyan, magenta, yellow and black). Specifically, as shown in FIG. 5, a group of color patches, regarded as a unit, includes 6 rows by 6 columns of cyan ink increasing by 20% successively in the direction of X-axis and magenta ink similarly increasing in the direction of Y-axis. Six such color patch groups are arranged to form a row in the direction of X-axis with yellow ink increasing by 20% successively, and six such rows are arranged in the direction of Y-axis with black ink increasing by 20% successively. Thus, 1,296 color patches are arranged as having successively varying dot percentages for the CMYK colors. In this specification, black is referred to as K or Bk as appropriate.

Laterally of the 1,296 color patches in the reference chart, a plurality of color patches SP1 are arranged for printing a color corresponding to a particular color to be reproduced especially faithfully in an image actually printed. That is, where flesh color is a particular color to be reproduced especially faithfully in a printed image, a plurality of color patches for printing a color corresponding to flesh color are arranged separately from the 1,296 color patches.

Laterally of the 1,296 color patches in the reference chart, a plurality of color patches SP2 also are arranged for reflecting a deterioration in color reproducibility due to a trapping rate. That is, when printing is carried out in a plurality of color inks successively, a preceding ink already transferred to printing paper lowers a trapping rate of an ink that follows. Thus, when printing is carried out in the order of K, C, M and Y, color patches should, preferably, be arranged in fine details for shadow portions of preceding inks (C with respect to M and Y, and M with respect to Y) in order to cope with the lowered trapping rates. For this reason, such color patches SP 2 are arranged laterally of the 1,296 color patches in the reference chart. Since the ink of color K is not applied to areas printed in the other color inks, K need not be considered for the color patches SP2.

Referring to FIG. 4 again, this reference print is placed on the table 12 of the print quality measuring apparatus noted hereinbefore, and color data of this reference print is obtained by the image pickup unit 14 (step S2). This color data is stored in the image memory 24.

The first image data for recording the reference chart on the printing plates is compared with the color data of the reference print to create conversion tables showing a relationship between image data for recording the image on printing plates and color data resulting from printing with the printing plates (step S3). More particularly, conversion tables for conversion from CMYK to RGB are created by using dot percentages of CMYK obtained from the first image data which may, for example, be platemaking data itself or PPF (Print Production Format) data according to the CIP3 (International Cooperation for Integration of Prepress, Press and Postpress) standards, and matching the dot percentages of CMYK with RGB values obtained by reading the reference print. These conversion tables are stored in the memory 25.

It is desirable to store the conversion tables with information on conditions set in time of creating the conversion tables. This creating condition information is information on printing conditions set in time of printing the above reference print but those which cannot be determined uniformly in time of actual printing, such as the type of printing paper, the type of ink, information on printing machines, standard print density, the order of colors to be used in printing and so on. By storing the conversion tables together with the creating condition information in this way, a desired conversion table may be used in accordance with the creating conditions set in time of printing. The operator may add correction data to these conversion tables as he or she wishes.

Where a plurality of printing machines are used, the above preliminary process is carried out for each printing machine. Where a plurality of different printing standards with different coloring characteristics are adopted for the same printing machine, the above preliminary process is carried out for each printing standard.

After the above preliminary process, a representative color, a gray control color and a Bk control color for use in controlling ink feeding rates are determined from second image data used to make printing plates recording a desired image to be actually printed in a printing process (steps S4, S5 and S6). The second image data is supplied from the image data source 27 shown in FIG. 3.

A representative color is determined first (step S4). This representative color determining step is executed following a sequence shown in FIG. 6.

First, the PPF data (CMYK data, individual density data in each CMYK) is fetched from the image data source 27 (step S51). Next, this PPF data is converted to data with RGB tones (step S52). Considering that the CMYK data has 0 to 255 eight-bit values, the conversion is performed by the formulas (1)–(3) set out below. Negative RGB values are regarded as zero.

$$R=255-(C+K) \quad (1)$$

$$G=255-(M+K) \quad (2)$$

$$B=255-(Y+K) \quad (3)$$

Next, edge components are extracted and removed from the RGB image (step S53). That is, when an edge amount which is a sum of differences (absolute values) between a given pixel and pixels adjacent thereto in the four directions exceeds a fixed value, this given pixel is regarded as an edge pixel. Such edge pixels are excluded from the subsequent process.

The RGB image is divided into sections corresponding to ink keys in each ink well of the printing machine (step S54). The subsequent steps (step S55 et seq.) are executed for each divided section.

First, pixels with heavy contributions of Bk (black) ink are extracted and removed (step S55). That is, of the data of CMYK before conversion to RGB, pixels with a minimum value of CMY smaller than the value of K are regarded as pixels with heavy contributions of Bk, and are excluded from the subsequent process.

Next, a three-dimensional histogram is created with the RGB values of the remaining pixels (step S56). Specifically, a three-dimensional region is appropriately divided for every color component of RGB to form equally divided cubes with one side including a predetermined tonal range, and then a frequency distribution is determined for respective class intervals. A process of creating this three-dimensional histogram is described in detail in Japanese Unexamined Patent Publication No. 11-296672 (1999) in the name of Assignee herein.

In this embodiment, the histogram is created with the RGB values. Instead, a frequency distribution may be created with a different color density value, such as CMY values or different color system, such as L*a*b.

Next, a color expressed by the intervals of the histogram is weighted by multiplying the frequency by an appropriate factor (step S57). When it is desired to give priority to flesh color in the picture as representative color, its color gamut is multiplied by a large factor. An interval having a maximum frequency after the multiplication by the factor is determined to be the color gamut serving as representative color, and only the pixels included in this interval are considered in the subsequent process.

In the above description, a histogram is created to determine a color gamut serving as representative color. Alternatively, the operator may designate a predetermined color gamut in place of the interval having the maximum frequency. In this case, the calculation of frequencies is unnecessary.

Next, isolated points are removed from the pixels included in the interval of maximum frequency resulting from the multiplication (step S58). That is, outermost pixels of the areas formed by the pixels included in the interval of maximum frequency resulting from the multiplication are removed as isolated points. This operation is repeated until the total number of pixels in all areas becomes 1 or 0 (step S59).

When the number of remaining pixels is 1, the CMYK values of this pixel is regarded as forming the representative color, and the position of the pixel is regarded as the position of the representative color. When the number of remaining pixels is 0, the CMYK values of one of the pixels that remained to the last, e.g. a pixel near the center of the sections corresponding to the ink keys, are regarded as forming the representative color, and the position of this pixel is regarded as the position of the representative color. In this way, a representative color and its position are determined (step S60).

The position of maximum area formed by the pixels (area of a series of pixels) included in the interval of maximum frequency after the removal of isolated points is selected to be the position of representative color as noted above. This is done to avoid the influence of errors caused by the intrinsic noise of the image pickup unit 14, and the influence of alignment errors occurring when comparing reference color data described hereinafter and color data of the position of the representative color of a printed image.

In the above embodiment, one pixel remaining after the removal of isolated points is regarded as the pixel corresponding to the representative color, and the CMYK values of this pixel are regarded as forming the representative color. The representative color may be obtained from an average or weighted average of the CMYK values of that pixel and a number of adjacent pixels. This measure is effective for lessening the influence of noise included in pixels.

Referring again to FIG. 4, a gray control color expressed in a substantially achromatic color and its position are determined next (step S5).

Figure 6:
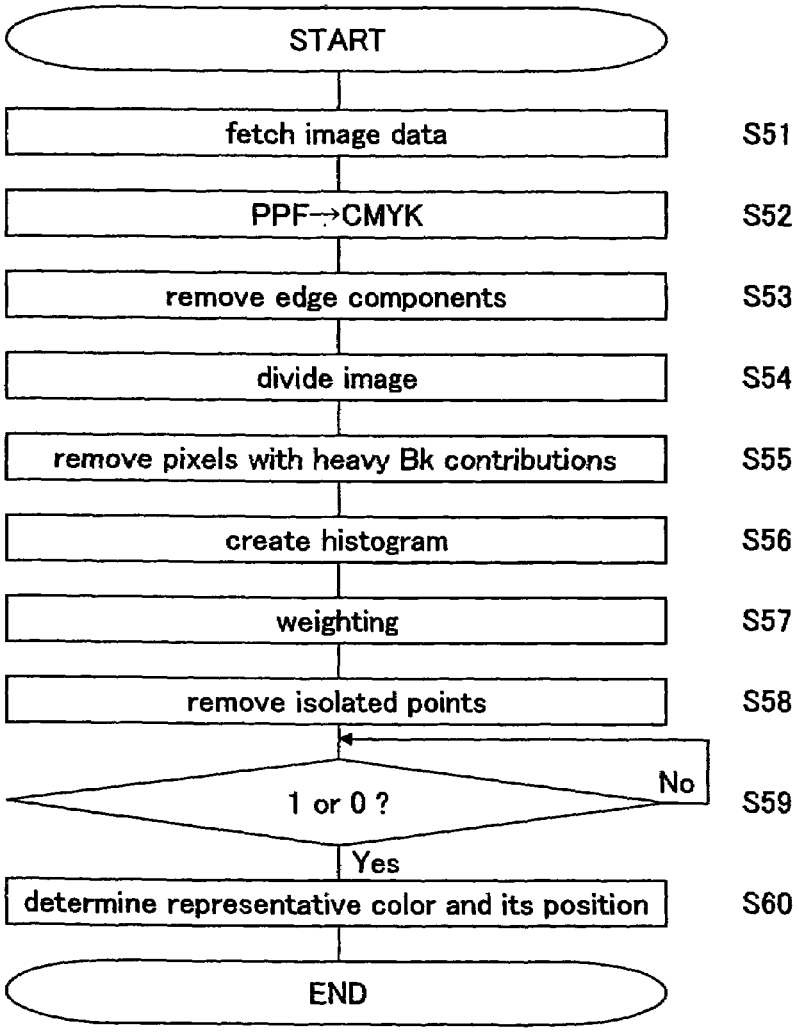
FIG. 6 is a flow chart of a representative color determining step.

This gray control color determining step is executed by a sequence similar to that of the representative color determining step shown in FIG. 6. However, in the gray control color determining step, step S57 in FIG. 6 is executed to multiply the intervals of the histogram corresponding to gray by a factor of 1 or more, so that a gray portion is selected with priority in step S58. Of course, a predetermined color gamut may be designated directly as an interval presenting the gray control color. When the selected gray region fails to have a fixed area, that is when the number of repetitions made in step S59 does not reach a fixed number, the section corresponding to one of the ink keys are regarded as being smaller than a predetermined gray area, and no gray control color is determined.

Next, a Bk control color expressed in black and its positions are determined (step S6).

This Bk control color determining step is executed by a sequence similar to that of the representative color determining step shown in FIG. 6. However, in the gray control color determining step, step S55 in FIG. 6 is executed to extract and remove pixels with minor contributions of Bk (black) ink. That is, of the CMYK data, the pixels with a maximum value of CMY larger than the value of K are regarded as pixels with minor contributions of Bk, and are excluded from the subsequent process. When the selected Bk region fails to have a fixed area, that is when the number of repetitions made in step S59 does not reach a fixed number, the section corresponding to one of the ink keys are regarded as being smaller than a predetermined Bk area, and no Bk control color is determined.

Figure 7:
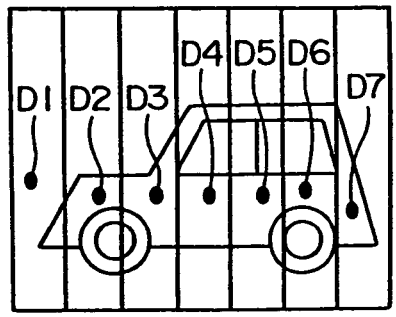
FIG. 7 is an explanatory view showing positions of a representative color, a gray control color and a black control color.
Figure 7:
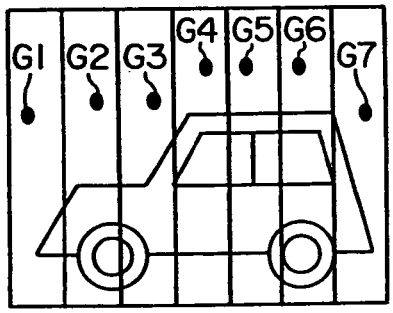
Figure 7:
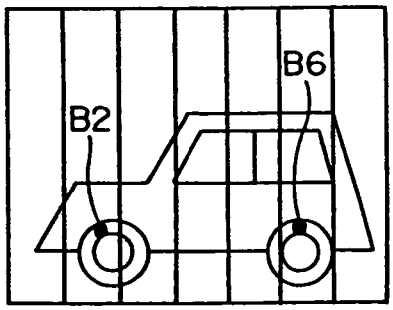
Figure 7:
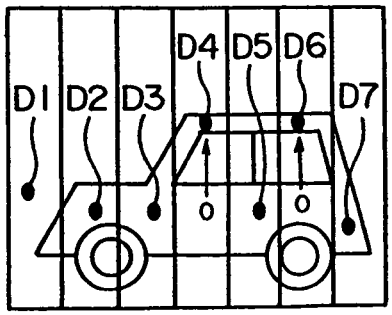

FIG. 7 shows explanatory views showing positions of the representative color, gray control color and Bk control color. In FIG. 7(*a*), D1–D7 denote positions of the representative color determined in the representative color determining step (step S4). In FIG. 7(*b*), G1–G7 denote positions of the gray control color determined in the gray control color determining step (step S5). In FIG. 7(*c*), B2 and B6 denote positions of the Bk control color obtained in the Bk color determining step (step S6).

The positions of the representative color, gray control color and Bk control color are displayed, along with the image to be printed, on the control panel 15 shown in FIG. 1. The operator may confirm the positions of the gray control color and Bk control color displayed on the control panel 15, and may, as necessary, change the positions of the representative color as shown in FIG. 7(*d*).

In the embodiment shown in FIG. 7, the image is divided into seven sections corresponding to the ink keys in each ink well of the printing machine. Further, in this embodiment, Bk control points are present only in the second section from the right and in the second section from the left.

Referring again to FIG. 4, after the above representative color determining step, gray control color determining step and Bk control color determining step, one of the conversion tables is fetched from memory 25. This conversion table is used to execute a reference color data conversion step for converting the data of the representative color and gray control color in the second image data into reference color data (Step S7). More particularly, CMYK values of pixels corresponding to a representative point and gray control point are extracted from the PPF data of the second image data, the CMYK values are converted into RGB values by using the conversion table, and then these values are converted into dot percentages to obtain reference color data. Such conversion may be carried out also for a Bk control point.

In the above reference color data conversion step, when the representative point or gray control point does not belong to any one of the color patches shown in FIG. 5, data of a plurality of adjacent color patches may be used to calculate data of the representative point or gray control point by least squares method or linear interpolation method.

After the above step, actual prints are made (Step S8). These prints have a desired image to be actually printed. During the printing operation, the operator extracts a print from a discharge station of a printing machine, and places the print on the table 12 of the print quality measuring apparatus shown in FIGS. 1 and 2.

The image of the print is read by the image pickup unit 14 (Step S9). RGB values of the pixels corresponding to the representative point and gray control point in the data of the image of the print are extracted and converted into dot percentages to obtain print color data. This print color data is stored in the image memory 24 of the control unit 20.

Next, a comparative calculation is carried out of the reference color data obtained in the reference color data conversion step and the print color data to determine whether the color tone of the print is proper (Step S10).

In the comparative calculation step, the print color data obtained by reading the print is not compared directly with the image data used in recording the image on the printing plates as in the prior art. Instead, the print color data used in recording the image on the printing plates is made reference color data by using a conversion table, and this reference color data is compared with the print color data. It is thus possible to control the ink feeding rates accurately regardless of the printing characteristics of the printing machine.

Subsequently, the ink feeding rates of the ink feeders of the printing machine are adjusted based on the result of the comparative calculation (Step S11). The color tone of the image printed is adjusted to the reference color tone by repeating steps S8–S11 a plurality of times.

In the foregoing embodiment, the reference print and other prints are transported, for color data measurement, to the dedicated print quality measuring apparatus shown in FIGS. 1 and 2. Alternatively, an image pickup mechanism may be disposed adjacent the discharge station of the printing machine for measuring images of a reference and other prints by using this image pickup mechanism.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2002-377217 filed in the Japanese Patent Office on Dec. 26, 2002, the entire disclosure of which is incorporated herein by reference.

What is claimed is:

1. An ink feeding rate control method for adjusting ink feeding rates of a printing machine when performing a printing operation using printing plates with an image recorded thereon based on printing data, said method comprising: a reference print preparing step for making a first printing plate by recording an image thereon based on first image data for recording a reference chart including a plurality of color patches set beforehand, and printing a reference print with said first printing plate; a reference print color density measuring step for obtaining color data of said reference print by reading said reference print prepared in said reference print preparing step; a conversion table creating step for creating a conversion table based on said first image data and said color data of said reference print and showing a relationship between said first image data and said color data; a reference color data converting step for converting data of predetermined measurement positions of second image data for recording a desired image on the printing plates for use in printing, into reference color data by using said conversion table; a print preparing step for making a second printing plate by recording an image thereon based on said second image data, and printing a print with said second printing plate; a print color density measuring step for obtaining print color data of positions corresponding to said measurement positions by reading said print prepared in said print preparing step; and an ink feeding rate adjusting step for adjusting the ink feeding rates of said printing machine based on a result of comparison between said reference color data obtained in said reference color data converting step and said print color data.

2. An ink feeding rate control method as defined in claim 1, wherein said reference chart includes a plurality of color patches with successively varying dot percentages for each of YMCK colors.

3. An ink feeding rate control method as defined in claim 2, wherein said measurement positions are positions having a representative color characterizing the image of the print.

4. An ink feeding rate control method as defined in claim 3, wherein said representative color and the positions thereof are determined for respective sections corresponding to ink keys in each ink well of the printing machine.

5. An ink feeding rate control method as defined in claim 4, wherein said image data has three color components, said representative color being determined by classifying pixels in each of sections corresponding to said ink keys according to tones of each of the three color components, and determining said representative color and a position thereof from pixels included in a predetermined class interval.

6. An ink feeding rate control method as defined in claim 5, wherein a histogram with the tones of each of the three color components of each pixel in each of said sections is created, and said representative color and the position thereof are selected from pixels included in a class interval of maximum frequency in said histogram.

7. An ink feeding rate control method as defined in claim 1, wherein said reference chart includes color patches having dot percentages for printing a color corresponding to a particular color to be reproduced faithfully.

8. An ink feeding rate control method as defined in claim 7, wherein said measurement positions are positions having a representative color characterizing the image of the print.

9. An ink feeding rate control method as defined in claim 8, wherein said representative color and the positions thereof are determined for respective sections corresponding to ink keys in each ink well of the printing machine.

10. An ink feeding rate control method as defined in claim 9, wherein said image data has three color components, said representative color being determined by classifying pixels in each of sections corresponding to said ink keys according to tones of each of the three color components, and determining said representative color and a position thereof from pixels included in a predetermined class interval.

11. An ink feeding rate control method as defined in claim 10, wherein a histogram with the tones of each of the three color components of each pixel in each of said sections is created, and said representative color and the position thereof are selected from pixels included in a class interval of maximum frequency in said histogram.

12. An ink feeding rate control method as defined in claim 1, wherein said measurement positions are positions having a representative color characterizing the image of the print.

13. An ink feeding rate control method as defined in claim 12, wherein said representative color and the positions thereof are determined for respective sections corresponding to ink keys in each ink well of the printing machine.

14. An ink feeding rate control method as defined in claim 13, wherein said image data has three color components, said representative color being determined by classifying pixels in each of sections corresponding to said ink keys according to tones of each of the three color components, and determining said representative color and a position thereof from pixels included in a predetermined class interval.

15. An ink feeding rate control method as defined in claim 14, wherein a histogram with the tones of each of the three color components of each pixel in each of said sections is created, and said representative color and the position thereof are selected from pixels included in a class interval of maximum frequency in said histogram.

* * * * *